United States Patent [19]

Loesel, Jr. et al.

[11] Patent Number: 5,014,880

[45] **Date of Patent: * May 14, 1991**

[54] LIQUID DISPENSING ASSEMBLY

[75] Inventors: John L. Loesel, Jr., San Clemente; Channing W. Gilson, Pasadena, both of Calif.

[73] Assignee: The Dial Corporation, Phoenix, Ariz.

[ * ] Notice: The portion of the term of this patent subsequent to Dec. 20, 2005 has been disclaimed.

[21] Appl. No.: 322,527

[22] Filed: Mar. 13, 1989

[51] Int. Cl.[5] ..... B67D 5/06

[52] U.S. Cl. ..... 222/181; 222/214; 222/494; 248/311.3

[58] Field of Search ..... 222/180, 181, 185, 160, 222/162, 212, 214, 491, 494; 248/311.3; 403/381

[56] References Cited

U.S. PATENT DOCUMENTS

| | | | |
|---|---|---|---|
| 3,078,016 | 2/1963 | Judy | 222/181 |
| 3,409,257 | 11/1968 | Elm | 248/65 |
| 3,623,641 | 11/1971 | Hansen et al. | 222/105 |
| 3,926,347 | 12/1975 | Low et al. | 222/214 X |
| 4,121,800 | 10/1978 | McClellan | 248/207 |
| 4,166,553 | 9/1979 | Fraterrigo | 222/181 |
| 4,258,865 | 3/1981 | Vahl et al. | 222/213 |
| 4,324,348 | 4/1982 | Johnson et al. | 222/181 |
| 4,463,876 | 8/1984 | Swallert | 222/94 |
| 4,470,523 | 9/1984 | Spector | 222/181 |
| 4,474,314 | 10/1984 | Roggenburg, Jr. | 222/494 |
| 4,530,448 | 7/1985 | Ponyicky | 222/181 |
| 4,565,303 | 1/1986 | Gilbertson | 222/103 |
| 4,634,022 | 1/1987 | O'Halloran | 222/95 |
| 4,650,095 | 3/1987 | Tella et al. | 222/153 |
| 4,792,064 | 12/1988 | Loesel, Jr. et al. | 222/181 |

FOREIGN PATENT DOCUMENTS

| | | | |
|---|---|---|---|
| 3333569 | 3/1985 | Fed. Rep. of Germany . | |
| 3626520 | 2/1988 | Fed. Rep. of Germany | 222/181 |
| 508386 | 7/1971 | Switzerland . | |
| 994781 | 6/1965 | United Kingdom . | |

*Primary Examiner*—Andres Kashnikow
*Assistant Examiner*—Gregory L. Huson
*Attorney, Agent, or Firm*—Richard G. Harrer; Bernard L. Howard

[57] ABSTRACT

A wall mounted assembly for dispensing various liquids which assembly includes a wall mounting bracket and container for the liquids, the container being releasably secured to the bracket at an end of the container which is opposite to the outlet end. Each of the front and rear surfaces of the container is provided with a channel which runs parallel to the bottom of the container. The wall mounting bracket is provided with an area for receiving the end of the container and such area has a pair of spaced apart laterally positioned projections which are about the same length as the channels on the container walls. The projections in the bracket engage the channels on the container to secure the container to the bracket.

8 Claims, 2 Drawing Sheets

LIQUID DISPENSING ASSEMBLY

BACKGROUND OF THE INVENTION

This invention relates to an assembly for dispensing various liquids such as soaps and shampoos.

It is well known to mount dispensers for dispensing liquids on a wall. Many such dispensers comprise flexible bags forming a reservoir or container for the liquids, such as liquid soap. The bags are manually compressed pressurizing the liquid contained therein and forcing it out through a suitable valve. The bags are generally replaceable, and after a bag has been emptied, a new liquid containing bag is inserted into the wall mounting assembly. The bags can be mounted to the wall by various means, including adhesives, suction cups, and mounting plates or brackets. For example, see U.S. Pat. Nos. 3,623,641; 4,166,533 and 4,470,523.

Special assemblies have also been devised for compressing the bags. These assemblies are typically coupled to the mounting assembly or housing and may comprise sliding lever assemblies that also actuate a valve structure, see U.S. Pat. No. 4,258,865; or pivotable housing members having projections that compress the bag during pivoting, see U.S. Pat. No. 4,324,348. These special compression assemblies are secured to a housing that encases the bag and are provided with moving parts that form the compression assemblies. As such, these assemblies are relatively complex, costly to manufacture, and in a number of instances, do not provide easy access for replacement of the flexible bags. Moreover, such bags are difficult at best to refill. In Loesel et al U.S. Pat. No. 4,792.064 there is disclosed a liquid dispenser of relatively simple structure and in which the reservoir container for the liquid is readily replaceable. The present invention is an improvement to such a liquid dispenser.

SUMMARY OF THE INVENTION

The present invention is directed to a wall mounted assembly for dispensing liquids such as liquid soaps and the like which is of relatively simple structure and thus easy to manufacture and of relatively low cost. The container for the liquids is not only securely held within the assembly, but is very easily removed from the assembly for refilling or replacement. In one preferred embodiment, the container is transparent and thus the amount of liquid present in the container is readily ascertainable and therefore it is easy to tell when replacement or refill is required.

The assembly includes a bracket which is attachable to a surface such as a wall and which bracket receives and secures the container for the liquids. The container can be formed of a relatively rigid yet compressible or "squeezable" plastic material such as polyvinyl chloride, one end of the container being provided with a dispensing closure to allow the fluids to leave the container as well as to seal the fluids in the container. The opposite end of the container is provided with means which cooperate with means provided in the bracket for releasably securing the container to the bracket. In the container, such means include a channel or recessed area formed in each of the opposite sides of the container near its base, which channels cooperate with projections provided in the container securing area of the bracket to reliably secure the container to the bracket. Once the container is secured in the bracket, the dispensing closure is opened and as the user presses on the front side of the container to pressurize the liquid contents, flow of the contents takes place through the closure.

DETAILED DESCRIPTION OF THE INVENTION

Figure 1:
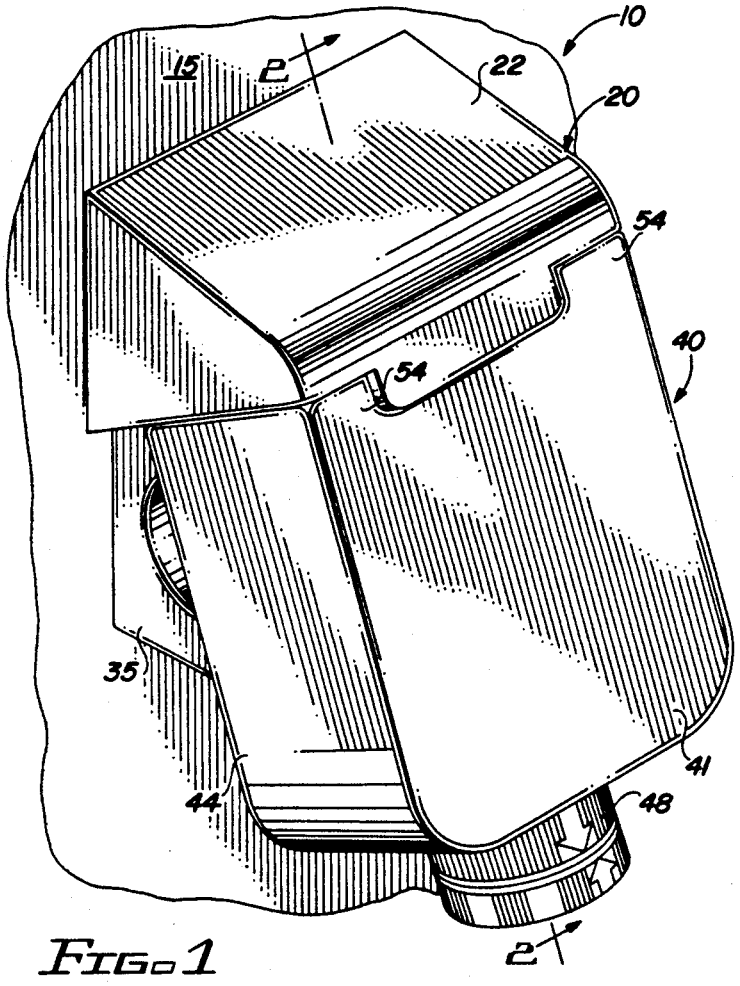
FIG. 1 is a perspective view of the liquid dispensing assembly including mounting bracket and container.
Figure 2:
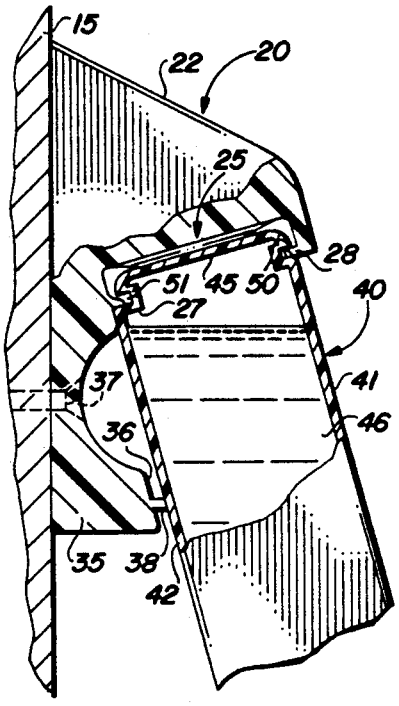
FIG. 2 to a partial sectional view of the assembly of FIG. 1 taken on the line 2—2 of FIG. 1.
Figure 6:
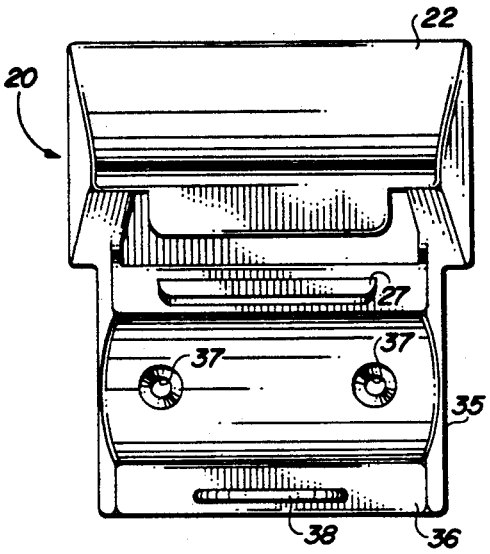
FIG. 6 is a front perspective view of the wall mounting bracket of the liquid dispensing assembly.

FIG. 1 shows a perspective view of the liquid dispensing assembly shown generally at 10 mounted to wall 15 and comprising a relatively rigid yet compressible container 40 and bracket 20, the container being releasably secured in the bracket. As shown in FIG. 2, the bracket includes means shown generally in the area designated 25 for receiving and securing the bottle to the bracket and stem 35 having surface 36 which preferably extends at an oblique angle from vertical wall 15. As shown in FIG. 6, stem 35 may be provided with holes 37 so that the bracket can be secured to the wall by means of screws or other fasteners. The bracket may also be secured to a wall by an adhesive. The surface 36 of the stem is preferably provided with lateral projection 38 which, when the container is secured in the bracket 20, contacts the rear surface 42 of bottle 40. The upper portion of bracket 20 is preferably provided with an inclined surface 22 so as not to provide a shelf for retention of objects such as cigarettes and the like.

Figure 3:
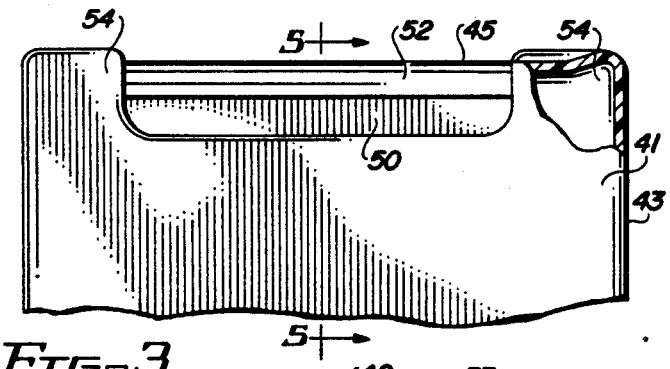
FIG. 3 is a partial front view of the container employed in the liquid dispensing assembly.
Figure 4:
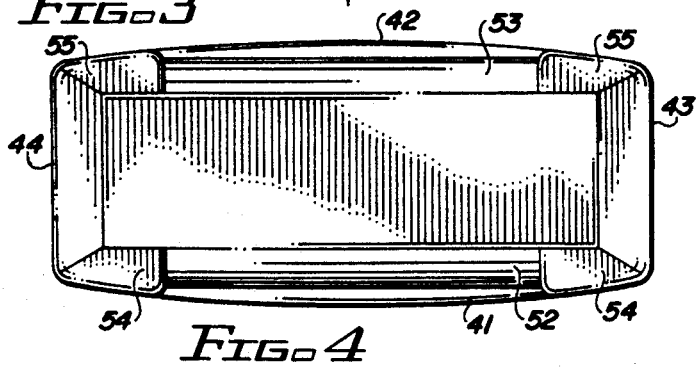
FIG. 4 is an end view of the container employed in the liquid dispensing assembly.

Referring particularly to FIGS. 2–5, one end of container 40 is provided with outlet means or dispensing closure 48 which provides an orifice for dispensing liquid 46 contained in the bottle. Closure 48 is preferably of the self-closing venting type such as disclosed in U.S. Pat. No. 4,474,314. Container 40 has front and rear surfaces 41 and 42 respectively and sides 43 and 44 and bottom end 45. In a preferred embodiment, each of front and rear surfaces 41 and 42 is provided with a groove or channel 50 and 51 respectively, each of which are positioned near the bottom 45 of the container and are substantially parallel to the bottom of the container. As best shown in FIG. 3, it is preferred that channels 50 and 51 not run the entire width of the front and rear surfaces 41 and 42, but end at a short distance from sides 43 and 44 which thus provides for shoulders 54 and 55 which serve to prevent container 40 from being dislodged from the bracket by a side ways force.

Figure 5:
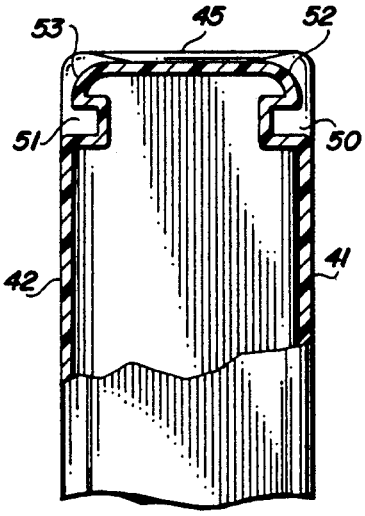
FIG. 5 is a partial sectional view of the container employed in the liquid dispensing assembly taken along the line 5—5 of FIG. 3.

Referring to FIGS. 2, 3 and 5, it will be seen that that portion of the bottom end of sides 41 and 42 of container 40 lying between shoulders 54 and 55 and from channels 50 and 51 to the bottom end of the container is rounded or crowned as shown at 52 and 53. This rounding of the ends of sides 41 and 42 facilitates securing and releasing the container in bracket 20.

Figure 8:
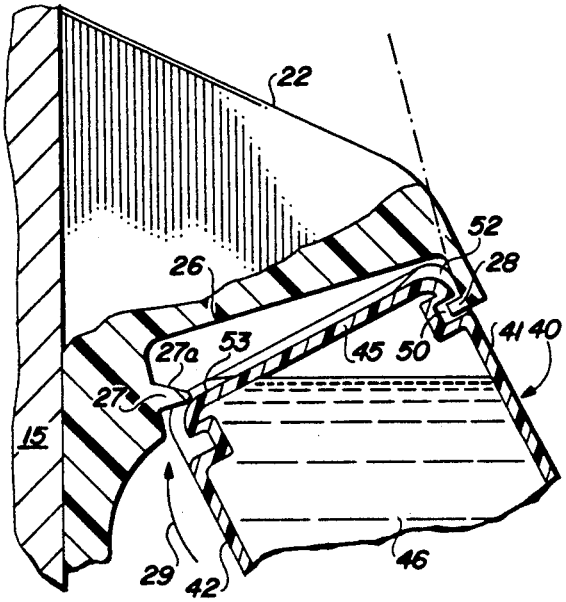
FIGS. 7–9 are partial side views of the liquid dispensing assembly showing the steps in securing the bottle in the wall mounting bracket.
Figure 7:
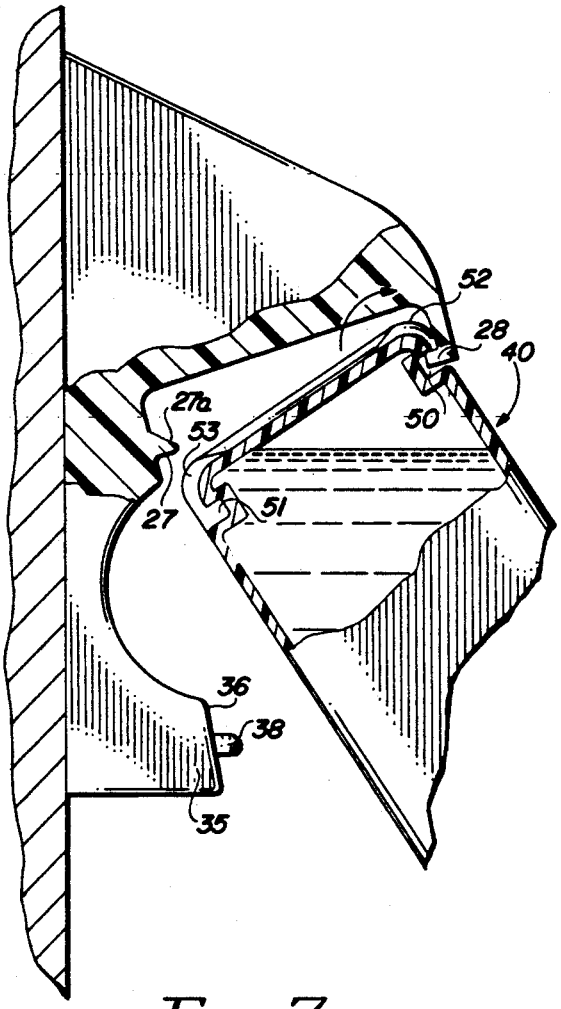
Figure 9:
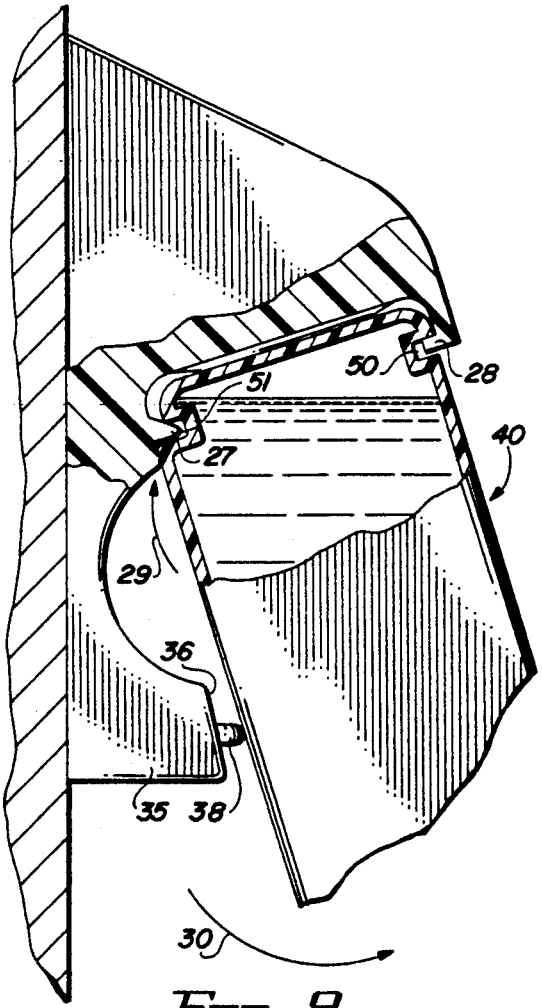

Wall mounting bracket 20 is provided with an area 25 which serves as the means for receiving and securing container 40 to the bracket. Such means include surface 26 which may generally conform to the shape of the bottom end 45 of container 40 which, as shown is substantially flat, and a pair of spaced apart laterally positioned securement projections 27 and 28. Preferably projections 27 and 28 are sized so that they are about the same length as channels 50 and 51 of container 40 and protrude at a distance such that they substantially fill channels 50 and 51. As best shown in FIGS. 7-9 and in its most preferred form, one edge 27*a* of projection 27 is tapered in cross section whereas projection 28 is substantially rectangular in cross section. This tapering of projection 27 aids in the release of container 40 from its wall mounting bracket. As shown, it is preferred that the bottom of container 40 be substantially flat which is an advantage in filling the bottle on a production line or in refilling the container, if desired. The bottom of the container can have a convex or concave shape. If it is desired to have a convex shape, surface 26 of the bracket would be shaped to conform to the shape of the bottom of the container.

FIGS. 7-9 show a sequence of steps involved in securing container 40 to bracket 20. As shown in FIG. 7, container 40, with liquid 46 is inverted so that the bottom end is facing up and then positioned so that projection 28 engages channel 50. Then, as shown in FIG. 8, the container 40 is rotated toward the bracket stem 35 as shown by the arrow 29 so as to bring channel 51 closer to projection 27. As this motion continues the rounded edge 53 of the container contacts projection 27 of the bracket, and then, as shown in FIG. 9, projection 27 is finally seated within channel 51. The container is then reliably secured in the bracket. To disengage the container, the foregoing steps are basically reversed. That is, the user grasps the container and exerts a downward and sideward force in the direction shown by arrow 30 of FIG. 9 using projection 28 as a fulcrum or pivot point. After the projection 27 has been disengaged from channel 51, projection 28 is disengaged from channel 50.

What is claimed is:

1. An assembly for dispensing liquids comprising a wall mounting bracket and a container for said liquids and wherein said container is releasably secured in said bracket and maintained in a position so that an outlet of the container is disposed downwardly when said assembly is mounted to a vertical surface, said assembly comprising:

a container for said liquids having opposed front and back surfaces, opposed side surfaces, a bottom end and outlet means positioned away from said bottom end, said container having means which cooperate with means in said bracket for releasably securing said container to said bracket, said container means comprising a channel formed in each of said front and back surfaces, said channels being opposed to each other and positioned substantially parallel to said bottom end, and located near said bottom end of said container, and wherein the bottom end of said container is provided with shoulders adjacent the ends of said channels to prevent said container from being dislodged from said bracket by a sideways force; and a wall mounting bracket comprising a stem and means for receiving and securing said container to said bracket, said bracket means comprising a pair of spaced apart lateral projections positioned above said stem, said projections being sized and positioned in said bracket such that a projection will engage each of said channels to thereby secured said container to said bracket, with a surface of said container positioned adjacent to a surface of said stem; said container being reversible about its vertical axis.

2. The assembly of claim 1 wherein said stem is provided with an oblique surface which contacts the back surface of said container.

3. The assembly of claim 2 wherein said stem surface is provided with a projection which contacts the back surface of said container.

4. The assembly of claim 3 wherein said container is relatively rigid and compressible.

5. The assembly of claim 4 wherein said channels do not extend the entire width of said front and back container surfaces.

6. The assembly of claim 5 wherein that portion of the bottom end of the front and rear sides of said container extending from said channels to the bottom end of said container is rounded.

7. The assembly of claim 6 wherein the bottom end of said container is substantially flat and said container is transparent.

8. The assembly of claim 7 wherein said surface of one of said container engaging projections on said bracket is tapered in cross section and the other projection is substantially rectangular in cross section.

* * * * *